United States Patent [19]

Benjamin

[11] Patent Number: 4,891,024

[45] Date of Patent: Jan. 2, 1990

[54] PEDAL BOAT PROPULSION SYSTEM

[76] Inventor: Robert J. Benjamin, Box 1148, Fort Benton, Mont. 59442

[21] Appl. No.: 184,070

[22] Filed: Apr. 20, 1988

[51] Int. Cl.[4] ..... B63H 16/20

[52] U.S. Cl. ..... 440/28; 440/26; 440/30; 114/144 R

[58] Field of Search ..... 114/144 R; 440/21, 26, 440/27, 28, 29, 30, 31, 53, 63, 75; 280/282

[56] References Cited

U.S. PATENT DOCUMENTS

| | | | |
|---|---|---|---|
| 650,224 | 5/1900 | Beyer . | |
| 1,462,027 | 7/1923 | Brady . | |
| 1,471,747 | 10/1923 | Mierzwinski . | |
| 1,695,304 | 12/1928 | Turner | 440/30 |
| 2,195,745 | 4/1940 | Gariepy | 440/29 |
| 2,664,064 | 12/1953 | Prenosil, Sr. . | |
| 3,010,421 | 11/1961 | Perkins | 440/28 |
| 3,088,430 | 5/1963 | Champney | 440/75 |
| 3,211,125 | 10/1965 | Yarbrough . | |
| 4,526,392 | 7/1985 | Berkstresser | 280/282 |
| 4,572,535 | 2/1986 | Stewart et al. | 280/282 |

FOREIGN PATENT DOCUMENTS

| | | | |
|---|---|---|---|
| 944511 | 4/1949 | France | 440/26 |
| 484201 | 9/1953 | Italy | 440/30 |
| 8500552 | 12/1985 | Netherlands | 440/26 |

*Primary Examiner*—Sherman D. Basinger
*Assistant Examiner*—Thomas J. Brahan
*Attorney, Agent, or Firm*—Fleit, Jacobson, Cohn, Price, Holman & Stern

[57] ABSTRACT

A marine propeller equipped drive unit is provided for support from the transom of a boat in generally the same manner an outboard motor is supported from a boat transom and a pedal crank assembly is provided for mounting within a boat forward of a transverse seat thereof to be operated by the legs of a person supported from the seat, the pedal crank assembly including an output shaft and the drive unit including an upper end input shaft and there being provided an open drive shaft assembly extending between and operably connecting the output shaft to the input shaft.

11 Claims, 2 Drawing Sheets

PEDAL BOAT PROPULSION SYSTEM

BACKGROUND OF THE INVENTION

1. Field of the Invention

Many fishermen utilize lightweight boats equipped with oars or paddles in small bodies of water. Further, fishing is also carried out in water reservoirs in which fuel burning motorized outboard propulsion systems are not allowed and many fishermen prefer not to use electric trolling motors in view of the expense involved and the limited amount of electrical energy which may be supplied to an electric trolling motor from a storage battery before the storage battery must be recharged. Accordingly, a definite need exists for an efficient small boat propulsion system which may be powered by an occupant of the boat with relative ease and while the boat occupant has both hands free for manipulating a fishing rod and reel. 2. Description of Related Art Various different forms of boat occupant powered propulsion systems for lightweight boats heretofore have been provided such as those disclosed in U.S. Pat. Nos. 650,224, 1,462,027, 1,471,747, 2,664,064, 2,703,065 and 3,211,125. However, these previously known boat occupant powered propulsion systems do not include the overall combination of structural features of the instant invention.

SUMMARY OF THE INVENTION

The propulsion system of the instant invention is adapted to be used in conjunction with a lightweight boat having a rear transom and a transverse seat within the boat spaced forward of the transom. The propulsion system includes a swivel seat and an associated pedal crank power input assembly as well as an outboard-type marine propeller equipped drive unit and an open drive shaft extends between and operably drivingly couples a power output shaft of the pedal crank assembly to the power input shaft of the drive unit, the open drive shaft extending through a hollow base for the swivel seat and the swivel seat hollow base including structure for removable attachment to the transverse boat seat.

The propulsion system also includes a steering control operatively associated with the swivel seat and constructed in a manner whereby the drive unit may be adjustably angularly displaced, by the legs of the seat occupant, about an upstanding axis while the occupant is powering the pedal crank assembly of the propulsion system. In this manner, not only can an occupant of the swivel seat power the propulsion system without the use of his hands, but steering of the drive unit also may be accomplished without use of the hands of the swivel seat occupant.

The main object of this invention is to provide a pedal-type boat propulsion system for lightweight fishing boats and which may be powered by a single occupant of the associated boat.

Another object of this invention is to provide a propulsion system in accordance with the preceding object and constructed in a manner whereby an occupant of the associated boat may power the propulsion system independent of use of his or her hands.

Still another object of this invention is to provide a propulsion system in accordance with the preceding objects and also constructed in a manner enabling steering of the propulsion system without use of the hands of the person powering the propulsion system.

A further object of this invention is to provide a propulsion system constructed in a manner including adjustments for adapting the propulsion system for use in boats wherein the rear transverse seats of boats are spaced different distances from the transom thereof.

Still another object of this invention is to provide a propulsion system adjustable to compensate for persons powering the system having different length legs.

Still another object of this invention is to provide a propulsion system including adjustment features thereof for compensating for boats having the rear transverse seat thereof spaced different distances above the bottom of the boat.

Yet another object of this invention is to provide a propulsion system of the outboard-type wherein the outboard drive unit may be adjustably tilted about a horizontal transverse axis.

Another very important object of this invention is to provide a propulsion system in accordance with the preceding objects and which may be readily transported to and from a conventional type of fishing boat with which the propulsion system is to be used.

Yet another object of this invention is to provide a pedal boat propulsion system incorporating an outboard-type of drive unit equipped with a marine propeller and wherein the marine propeller is driven through a chain drive system protected from the ambient water.

A final object of this invention to be specifically enumerated herein is to provide a pedal boat propulsion system in accordance with the preceding objects and which will conform to conventional forms of manufacture, be of simple construction and easy to use so as to provide a device that will be economically feasible, long-lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

Description of the Preferred Embodiment

Figure 1:
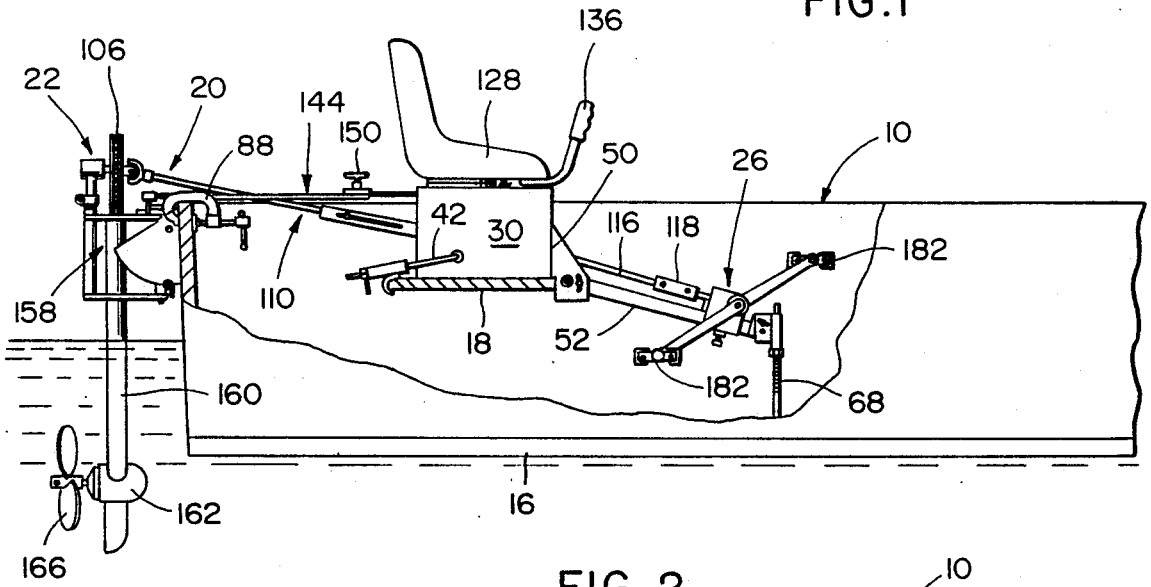
FIG. 1 is a fragmentary right side elevational view of a typical form of lightweight fishing boat having a transverse seat spaced forward of the transom thereof and with the pedal boat propulsion system of the instant invention operatively associated therewith, portions of the near side of the boat, transom and transverse seat being broken away and illustrated in vertical sections.
Figure 2:
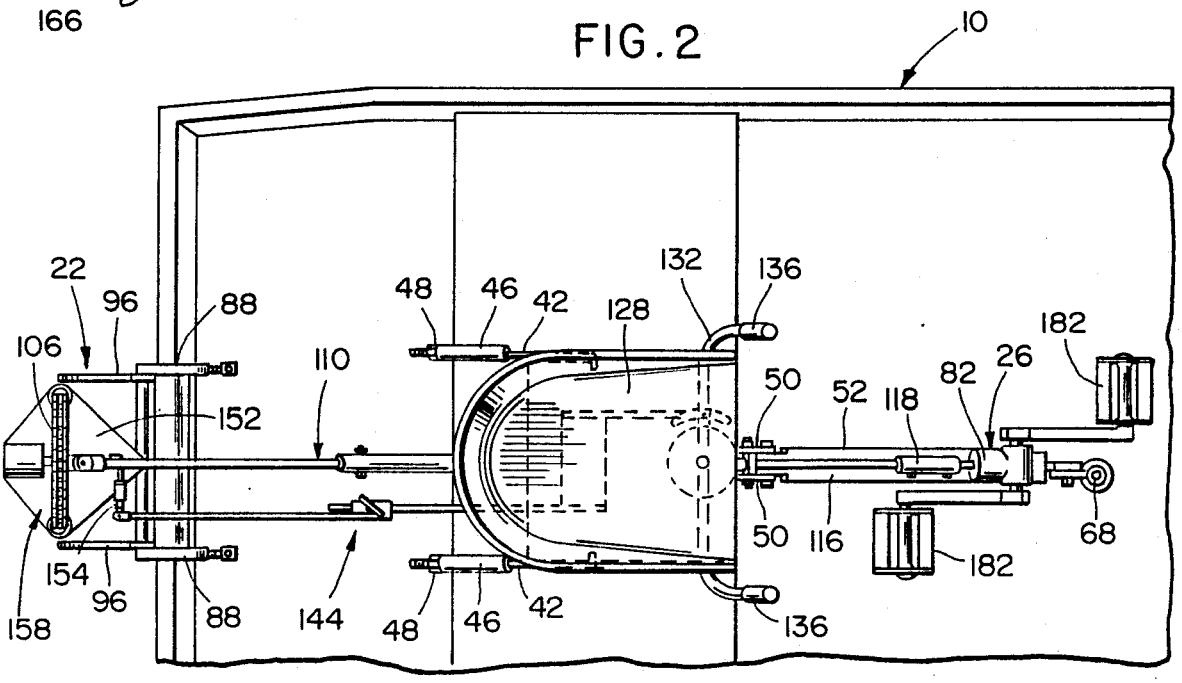
FIG. 2 is a fragmentary enlarged top plan view of the assemblege illustrated in FIG. 1.
Figure 4:
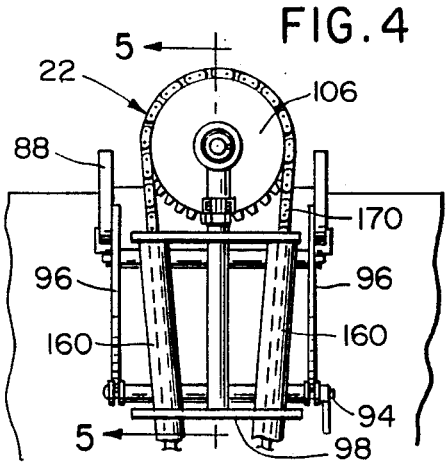
FIG. 4 is a fragmentary enlarged rear elevational view of the upper portion of the outboard-type drive unit of the propulsion system.
Figure 5:
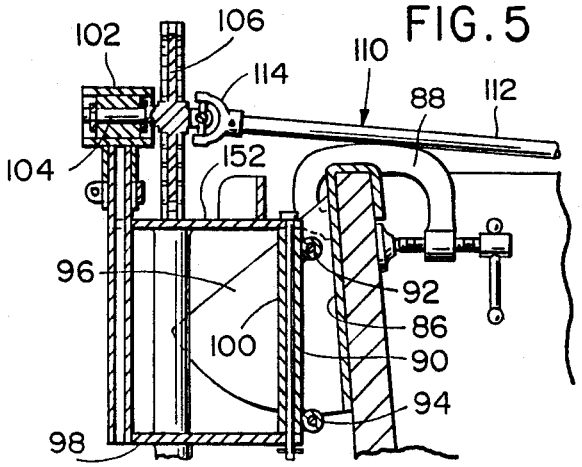
FIG. 5 is an enlarged fragmentary vertical sectional view taken substantially upon the plane indicated by the section line 5—5 of FIG. 4.

Referring now more specifically to the drawings, the numeral 10 generally designates a conventional lightweight fishing boat of the type normally propelled by oars, paddles or a low powered outboard motor. The boat 10 includes a rear transom 12, opposite sides 14 extending forward from the transom and a bottom 16 extending between and interconnecting the transom 12 and the sides 14. In addition, the boat 10 includes a transverse seat 18 spaced forward of the transom 12 and extending between the sides 14.

Although a low powered outboard motor of either the fuel or electric-powered type may be used in conjunction with the boat 10, fuel powered outboard motors are relatively expensive and are barred from some water supply reservoirs which are fished. In addition, electric trolling motors which might be used to propel the boat have a limited operational time determined by the current draw of the trolling motor and the capacity of the associated storage battery.

Therefore, many fisherman who have lightweight boats prefer to use manual power when fishing water supply reservoirs, but these reservoirs can be reasonably large and if the boat is to be propelled by a paddle or by oars, considerable physical effort can be required. In addition, a single occupant of the boat 10 must use both hands to either paddle or propel the boat through the utilization of oars and may not, at the same time, manipulate a fishing rod and reel.

The pedal boat propulsion system of the instant invention is referred to in general by the reference numeral 20 and includes an outboard-type drive unit referred to in general by the reference numeral 22, a seat assembly referred to in general by the reference numeral 24 and a pedal crank assembly referred to in general by the reference numeral 26.

The drive unit 22 is equipped to be clamp mounted upon the transom 12 in substantially the same manner in which a fuel or electric powered outboard propulsion unit is mounted on a boat transom, the seat assembly 24 is equipped to be removably mounted upon the seat 18 and the pedal crank assembly 26 enjoys a first adjustable connection with the seat assembly 24 and a second adjustable connection with the bottom 16.

Referring first to the seat assembly 24, the seat assembly includes a base referred to in general by the reference numeral 28. The base includes upright opposite side panels 30 interconnected by a horizontal transverse top panel 32 and the front of the base 28 may be substantially fully closed by a front panel 34. In addition, the lower marginal edges of the side panels 30 include outwardly directed flanges 36 for resting upon the upper surface of the seat 18 and the forward ends of the flanges 36 project forward of the front panel 34 and are downwardly directed as at 38 and then rearwardly directed as at 40 to define a rearwardly opening channel. Further, each of the side panels 30 has one end of an anchor rod 42 pivotally supported therefrom as at 44 for angular displacement about a horizontal transverse axis and the other end of each rod 42 has a hook equipped sleeve 46 rotatably and slidably mounted thereon, a lever arm equipped nut 48 being threadedly engaged on each rod 42 behind the corresponding sleeve 46.

The base 28 rests upon the seat 18 with the forward marginal edge of the seat seated within the rearwardly opening channel defined by the down and rearwardly angled forward ends of the flanges 36 and the hook equipped sleeves are hooked over the rear marginal edge of the seat 18 and tightened in position by the nuts 48. In this manner, the base 28 is securely removably supported from the seat 18.

Opposite side portions of the front panel 34 immediately on opposite sides of the central area thereof include forwardly projecting mounting flanges 50 between which the rear end of a forwardly and downwardly inclined support arm 52 is removably pivotally secured as at 54 and a clamp screw 56 is operatively associated with the support arm 52 and at least one of the mounting flanges 50 to retain the support arm 52 in adjusted angular position relative to the mounting flanges 50. The forward end of the support arm 52 includes a mount 58 from which a sleeve assembly 60 is pivotally supported for angular displacement about a horizontal axis as at 62 and a clamp screw 64 is operatively associated with the sleeve assembly 60 and the mount 58 for releasably retaining the sleeve assembly 60 in adjusted angular displacement relative to the mount 58. The threaded upper end portion 66 of a support leg 68 is slidingly received through the sleeve assembly 60 and has a threaded nut 70 thereon engageable with the sleeve assembly 60 in order to adjust the effective length of the support leg 68 projecting below the sleeve assembly 60, the lower end of the support leg 68 including an enlarged foot 72 thereon engaged with the bottom 16.

The pedal crank assembly 26 includes a mounting sleeve portion 74 slidingly disposed on the support arm 52 for adjustable shifting therealong and the mounting sleeve portion 74 includes a set screw 76 for securing the mounting sleeve portion 74 in adjusted shifted position along the support arm 52. Further, the pedal crank assembly 26 includes a rotary pedal crankshaft 78 journaled relative to the mounting sleeve portion 74 for rotation about a horizontal axis disposed transverse to the support arm 52 and the pedal crankshaft 78 is drivingly coupled to a rotary output shaft 80 generally paralleling the support arm 54 through the utilization of a right angle drive assembly 82 supported from the mounting sleeve portion 74, the pedal crankshaft 78 being journaled from the right angle drive assembly 82.

The drive unit 22 includes a mount portion 86 clamp mounted from the transom 12 as at 88 and having a support bracket 90 pivotally supported therefrom for angular displacement about a horizontal transverse axis as at 92 and including adjustable clamp means 94 clamp engaged with sector plate portions 96 for releasably clamp retaining the support bracket 90 in adjusted angularly displaced positions relative to the mount portion 86. Further, a support bracket 98 is pivotally supported from the support bracket 90 as at 100 for angular displacement relative thereto about an axis generally normal to the axis 92. The support bracket 98 includes an upper rear support portion 102 from which a rotary input shaft 104 is journaled and the shaft 104 projects forwardly of the support portion 102 and has a sprocket wheel 106 mounted thereon for rotation therewith. In addition, a drive shaft assembly referred to in general by the reference numeral 110 is provided and includes a rear end section 112 drivingly coupled to the rotary input shaft 104 through the utilization of a universal joint 114 and a front section 116 drivingly coupled to the rotary output shaft 80 through the utilization of a connecting sleeve 118 equipped with set screws 120 engaged with the front section 116 and the rotary output shaft 80. The sections 112 and 116 include front and rear ends, respectively, connected through the utilization of a universal joint 124 received between the mounting flanges 50 and through an opening (not shown) formed in the front panel 34.

The connecting sleeve 118 rigidly secures the front end of the front section 116 of the drive shaft assembly 110 to the rotary output shaft 80, the latter being journaled through the utilization of multiple bearings in the right angle drive assembly 82. Therefore, although the front and the rear sections 112 and 116 are slightly angulated relative to each other, a center bearing adjacent the universal joint 124 is not provided, the rotary speed of the drive shaft assembly 110 and the rotary torque transmitted thereby being relatively low. Of course, if desired, such a center bearing could be provided and oscillatably supported from the base 28.

The top panel 32 of the base 28 supports an operator's seat 128 therefrom through the utilization of a lazy susan bearing 130. Accordingly, the operator's seat 128 may be angularly displaced about a substantially vertical axis relative to the base 28.

Figure 8:
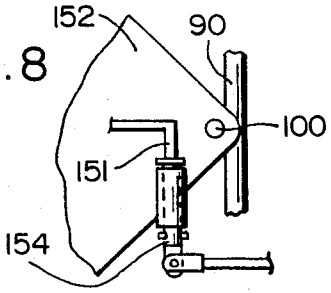
FIG. 8 is an enlarged fragmentary top plan view of the rear portion of the steering control of the pedal boat propulsion system and its connection to the outboard drive unit of the propulsion system.
Figure 7:
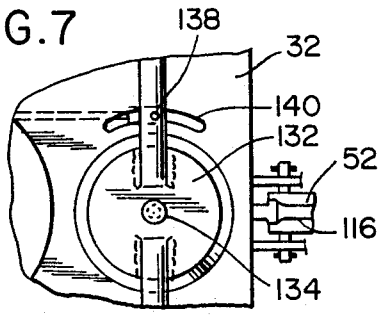
FIG. 7 is a fragmentary enlarged top plan view taken substantially upon the plane indicated by the section line 7—7 of FIG. 3.
Figure 6:
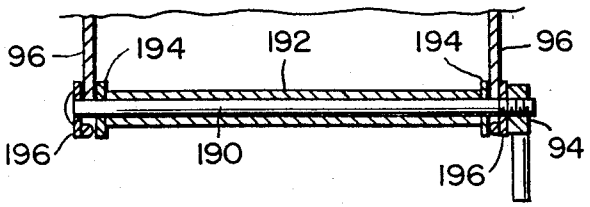
FIG. 6 is a fragmentary enlarged transverse vertical sectional view taken substantially upon the plane indicated by the section line 6—6 of FIG. 3.

Immediately forward of the lazy susan bearing 130, a handle bar assembly 132 is oscillatably supported from the top panel 32 as at 134 and the handle bar assembly 132 includes forwardly and upwardly inclined opposite end hand grip equipped levers 136 disposed slightly outward of opposite sides of the forward marginal portion of the operator's seat 128 when the latter is facing forward. The left lever 136 includes a depending pin 138 slidably received through an arcuate slot 140 formed in the top panel 32 and having the pivot axis of the handle bar assembly 132 as its center of curvature and the pin 138 projects below the top panel 132 and has the forward end of the front section 142 of a steering link assembly 144 pivotally secured thereto, the rear end of the front section 142 being adjustably telescopingly received through a sleeve 146 carried by the front end of the rear section 148 of the steering link assembly 144 and the sleeve 146 being equipped with a set screw 150 for releasably clampingly engaging the rear end of the front section 142. The rear end of the rear section 148 is connected to the outer end of a laterally projecting steering arm 151 carried by the top plate portion 152 of the support bracket 98 through the utilization of a double pivot connector 154, see FIG. 8.

The drive unit 22 incorporates a drive assembly referred to in general by the reference numeral 158 and including, in part, the support braket 98. The drive assembly 158 comprises that portion of the drive unit 22 oscillatably supported from the support bracket 90 and further includes a pair of downwardly convergent tubular guards 160 whose lower ends open into and are supported from a hollow housing 162 in which a rotary output shaft 164 is journaled. One end of the rotary output shaft projects outwardly of the housing 162 and is sealed relative thereto and provided with a screw-type marine propeller 166 removably mounted thereon. That portion of the shaft 164 contained within the housing 162 has a small diameter sprocket wheel 168 mounted thereon aligned with the sprocket wheel 106. An endless flexible chain 170 is trained about the sprocket wheels 106 and 168 and the two reaches of the chain 170 extending between the sprocket wheels 106 and 168 extend downwardly through the tubular guards 160, the upper and lower ends of the guards 160 being disposed substantially tangent to the sprocket wheels 106 and 168. Of course, the upper ends of the guards 160 are spaced appreciably above the water level 172 of the boat 10 and, accordingly, the tubular guards 160 prevent water from entering the hollow housing 162 via the drivetrain comprising the endless flexible chain 170.

Figure 3:
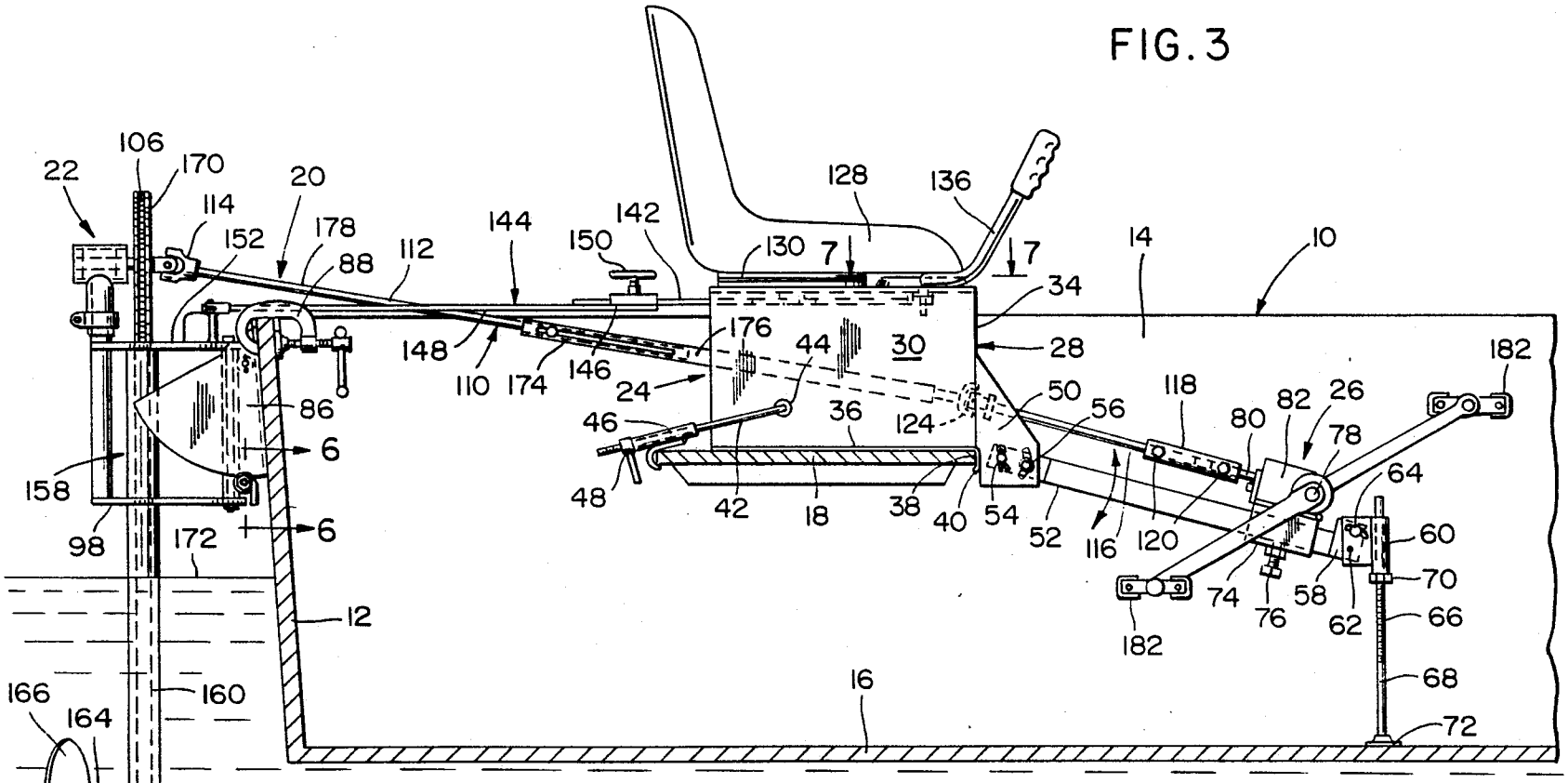
FIG. 3 is an enlarged fragmentary elevational view of the assemblege illustrated in FIG. 1.

It is believed readily apparent that the drive assembly 158 may be pivoted upward out of the water about the horizontal transverse axis 92 and retained in angularly displaced position relative to the mounting portion 86 through the utilization of the adjustable clamp means 94. When the drive assembly 158 is tilted upward, the necessary foreshortening of the drive shaft assembly 110 is accomplished by the pin and slot connection 174 connecting the front and rear shaft sections 176 and 178 of the rear section 148 of the drive shaft assembly 110, see FIG. 3. Further, when the drive assembly 158 is tilted up out of the water, the thumb screw 150 may be loosened, although loosening of the thumb or set screw 150 is not required in most cases in view of the length of the arcuate slot 140 and the fact that the double pivot connector at 154 is not excessively forwardly displaced relative to the boat 10 during upward pivotal movement of the drive assembly 158.

It is believed obvious that the drive unit 122 may be removably clamped to the transom 12 by the clamps as at 88 and that the seat assembly 24 may be clamped in position on the seat 18. Further, the support arm 52 and support leg 168 may be adjusted according to the leg length of the operator and the internal dimensions of the boat 10.

An operator seated on the seat 128 may engage his feet with the pedals 182 of the pedal crankshaft 78 and move his legs as though seated on a bicycle in order to impart rotary torque to the drive shaft assembly 110. The gear ratio between the pedal crankshaft 78 and the rotary output shaft 80 is 1 to 1, but such drive ratio may vary, if desired. Further, the drive ratio between the rotary input shaft 104 and the rotary output shaft 164 is 3 to 1. Likewise, this ratio may be varied, if desired.

Steerage of the drive assembly 158 is of course carried out through the utilization of the hand grip equipped levers 136. These levers may be gripped by the hands of the operator but also may be engaged along their inner opposing sides by the outer sides of knees of the operator disposed on the seat 128 and having his or her feet engaged with the pedals 182. In this manner, moderate steerage of the boat 110 may be effected independent of the hands of the operator while the operator is powering the drive unit 22 through utilization of the pedal crank assembly 26. Still further, inasmuch as the hand grip equipped levers 136 are disposed approximately immediately outward of the knees of an operator seated upon the seat, the operator's knees may be raised over the upper ends of the hand grip equipped levers 136 in order to enable the operator and the seat 128 to rotate almost 180° from a forward facing position. Still further, the adjustable clamp means at 94 comprises a lever equipped nut threaded on a clamp shaft 190 passing through a sleeve 192 mounted from the lower end of the member 90, the opposite ends of the sleeve 192 including washers 194 supported therefrom and the washers 194 and additional washers 196 on opposite ends of the clamp shaft 190 clampingly engaging the arcuate marginal edge portions of the sector plates 96 therebetween.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a boat having an aft transom and a support forward of said transom and spaced above a bottom structure of said boat, a pedal propulsion system including a pedal persons operator seat, mounting means mounting said operator seat stationary from said support, a drive unit mounted from said transom and including a lower rotary output shaft disposed to the rear of said transom and an upper rotary input shaft disposed above said transom, rotary torque transfer means drivingly connecting said input shaft to said output shaft, said output shaft having a marine propulsion member mounted thereon for rotation therewith to react upon water in which said boat is floating for propelling said boat through said water upon rotation of said output shaft, a pedal crank assembly stationarily mounted in said boat forward of said support and including a pedal crankshaft journaled for rotation about a horizontal axis extending transversely of said boat a drive shaft assembly extending between and drivingly connecting said pedal crankshaft to said input shaft, said operator seat including a seat base having a lower portion supported on and removably anchored relative to said support and an upper portion, said upper portion including a seat unit mounted therefrom, a support arm having front and rear ends, means mounting said rear end from said seat base for angular displacement about a horizontal axis extending transversely of said boat and support arm, the front end of said support arm including a depending adjustable length support leg supported from said bottom structure, support means mounting said pedal crank assembly on the front end of said support arm.

2. The boat and pedal propulsion system of claim 1 wherein said drive shaft assembly extends through said base below and above said upper and lower portions, respectively.

3. The boat and pedal propulsion system of claim 1 wherein said pedal crank assembly support means includes means mounting said pedal crank assembly on said support arm for adjustable stationary positioning therealong, said drive shaft assembly being adjustable in length.

4. The boat and pedal propulsion system of claim 3 wherein said drive unit includes a mount portion stationarily mounted from said transom, a support bracket mounted from said mount portion for adjusted angular displacement relative to said mount portion about a horizontal axis stationary relative to said mount portion and extending transversely of said boat, said drive unit being mounted from said support bracket for adjustable angular displacement relative thereto about an axis generally paralleling a ray extending between said rotary input and output shafts.

5. In combination with a boat having an aft transom and a stationary support forward of said transom spaced above a bottom structure of said boat, a pedal propulsion system including a pedal persons operator's seat, mounting means mounting said operator seat stationary from said support, a drive unit mounted from said transom and including a lower rotary output shaft disposed to the rear of and below said transom and an upper rotary input shaft disposed above said transom, rotary torque transfer means drivingly connecting said input shaft to said output shaft, said output shaft having a marine propulsion member mounted thereon for rotation therewith to react upon water in which said boat is floating for propelling said boat through said water upon rotation of said output shaft, a pedal crank assembly stationarily mounted in said boat forward of said support and including a pedal crankshaft journaled for rotation about a horizontal axis extending transversely of said boat, an elongated rearwardly and upwardly inclined open drive shaft assembly extending longitudinally of said boat and including front and rear ends, first drive means drivingly connecting said pedal crankshaft to the front end of said drive shaft assembly and universal connection drive means drivingly connecting the rear end of said drive shaft assembly to said input shaft, said drive unit including a mount portion stationarily mounted from said transom, a support bracket mounted from said mount portion for adjusted angular displacement relative to said mount about a horizontal axis stationary relative to said mount portion and extending transversely of said boat below said input shaft, and a drive assembly, including said rotary input and rotary output shafts and said rotary torque transfer means, mounted from said support bracket, as a unit, for adjustable angular displacement relative thereto about an axis generally paralleling a ray extending between said rotary input and output shafts, said drive shaft assembly being slidingly adjustable in length.

6. In combination with a boat having an aft transom and a support forward of said transom and spaced above a bottom structure of said boat, a pedal propulsion system including a pedal persons operator seat, mounting means mounting said operator seat stationary from said support, a drive unit mounted from said transom and including a lower rotary output shaft disposed to the rear of said transom and an upper rotary input shaft disposed above said transom, rotary torque transfer means drivingly connecting said input shaft to said output shaft, said output shaft having a marine propulsion member mounted thereon for rotation therewith to react upon water in which said boat is floating for propelling said boat through said water upon rotation of said output shaft, a pedal crank assembly stationarily mounted in said boat forward of said support and including a pedal crankshaft journaled for rotation about a horizontal axis extending transversely of said boat, an elongated drive shaft assembly extending longitudinally of said boat and including front and rear ends, first drive means drivingly connecting said pedal crankshaft to the front end of said drive shaft assembly and second drive means drivingly connecting the rear end of said drive shaft assembly to said input shaft, said drive shaft assembly extending over said support, said operator seat including a seat base having a lower portion supported on and removably anchored relative to said support and an upper portion, said upper portion including a seat unit mounted therefrom, said seat unit being mounted from said upper portion for angular displacement relative thereto about an upstanding axis, a transverse handlebar assembly mounted from said upper portion for angular displacement about a vertical axis and disposed beneath said seat, said handlebar assembly including opposite and upwardly projecting levers spaced closely adjacent and outward of opposite side portions of said seat, said drive unit including a mount portion stationarily mounted from said transom, a support bracket mounted from said mount portion for adjusted angular displacement relative to said mount portion about a horizontal axis stationary relative to said mount portion and extending transversely of said boat and a drive assembly, including said rotary input and output shafts and sazid rotary torque transfer means, mounted from said support bracket for adjustable angular displacement relative thereto about an axis generally paralleling a ray extending between said rotary input and output shafts, and a steering link assembly operatively connected between said handlebar assembly and drive assembly operative to effect angular displacement of said drive assembly responsive to angular displacement of said handlebar assembly.

7. The boat and pedal propulsion system of claim 6 wherein said steering link assembly is adjustable in length.

8. The boat and pedal propulsion system of claim 7 wherein said operator seat includes a seat base having a lower portion supported on and removably anchored relative to said support and an upper portion, said upper portion including a seat unit mounted therefrom, a support arm having front and rear ends, means mounting said rear end from said seat base for angular displacement about a horizontal axis extending transversely of said boat and support arm, the front end of said support arm including a depending adjustable length support leg supported from said bottom structure, support means mounting said pedal crank assembly on the front end of said support arm.

9. The boat and pedal propulsion system of claim 8 wherein said pedal crank assembly support means includes means mounting said pedal crank assembly on said support arm for adjustable stationary positioning therealong, said drive shaft assembly being adjustable in length.

10. In combination with a boat having an aft transom and a support forward of said transom spaced above a bottom structure of said boat, an outboard marine propulsion drive unit, a seat mounted from said support for angular displacement about an upstanding axis and including a forward marginal portion, a handlebar assembly mounted from said support vertically beneath said seat for angular displacement about an upstanding axis and including opposite side upwardly directed opposite end levers spaced closely adjacent opposite ends of said forward marginal portion for engagement of the opposing sides of said levers by the remote outer sides of the knees of a person seated on said seat, and a steering link assembly operatively connected between said handlebar assembly and drive unit for oscillating the latter in response to oscillation of said handlebar assembly.

11. The boat and drive unit combination of claim 10 wherein said steering arm assembly is adjustable in length.

* * * * *